US009309076B2

(12) United States Patent
Kato et al.

(10) Patent No.: US 9,309,076 B2
(45) Date of Patent: Apr. 12, 2016

(54) SHEET PROCESSING APPARATUS THAT ALIGNS SHEETS AND IMAGE FORMING SYSTEM

(71) Applicant: CANON KABUSHIKI KAISHA, Tokyo (JP)

(72) Inventors: Hitoshi Kato, Toride (JP); Naoki Ishikawa, Kashiwa (JP); Yasuo Fukatsu, Abiko (JP); Taishi Tomii, Matsudo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/576,861

(22) Filed: Dec. 19, 2014

(65) Prior Publication Data

US 2015/0183605 A1 Jul. 2, 2015

(30) Foreign Application Priority Data

Dec. 27, 2013 (JP) ..... 2013-272389

(51) Int. Cl.

| | |
|---|---|
| ***B65H 7/10*** | (2006.01) |
| ***B65H 7/20*** | (2006.01) |
| ***B65H 9/20*** | (2006.01) |
| ***B65H 5/06*** | (2006.01) |
| ***B65H 7/08*** | (2006.01) |
| ***B65H 9/00*** | (2006.01) |

(52) U.S. Cl.

CPC ..... *B65H 7/20* (2013.01); *B65H 5/062* (2013.01); *B65H 7/08* (2013.01); *B65H 7/10* (2013.01); *B65H 9/002* (2013.01); *B65H 9/20* (2013.01); *B65H 2404/1422* (2013.01); *B65H 2404/1424* (2013.01); *B65H 2511/20* (2013.01); *B65H 2511/242* (2013.01); *B65H 2513/53* (2013.01); *B65H 2557/24* (2013.01); *B65H 2701/1311* (2013.01); *B65H 2701/1313* (2013.01); *B65H 2701/1315* (2013.01); *B65H 2801/27* (2013.01)

(58) Field of Classification Search

CPC ..... B65H 9/101; B65H 2511/12; B65H 2701/1315; B65H 7/10; B65H 7/08; B65H 2511/242

USPC ..... 271/238, 240

See application file for complete search history.

(56) References Cited

U.S. PATENT DOCUMENTS 4,657,239 A * 4/1987 Ikesue et al. ..... 271/227
5,172,138 A * 12/1992 Okazawa et al. ..... 346/134

(Continued)

FOREIGN PATENT DOCUMENTS

JP 2005-042342 2/2005

*Primary Examiner* — Jeremy R Severson

(74) *Attorney, Agent, or Firm* — Fitzpatrick, Cella, Harper & Scinto

(57) ABSTRACT

A sheet processing apparatus capable of shortening time to align sheets. A first alignment member and a second alignment member are movable in a sheet width direction orthogonal to a sheet conveying direction, and align a sheet. A CPU controls the first and second alignment members to be moved in the sheet width direction. A skew sensor detects a skew amount and skew direction of the sheet. The CPU causes the first and second alignment members to be positioned at respective predetermined standby positions before the sheet is received between the first and second alignment member. Further, the CPU causes one of the first and second alignment members to be moved in a direction toward the sheet, based on the detected skew amount and skew direction, during conveyance of the sheet between the first and second alignment members.

14 Claims, 15 Drawing Sheets

(56) References Cited

U.S. PATENT DOCUMENTS

| | | | | |
|---|---|---|---|---|
| 5,284,333 | A | 2/1994 | Ishikawa | |
| 5,433,427 | A | 7/1995 | Ishikawa et al. | |
| 5,507,482 | A | 4/1996 | Tenpaku et al. | |
| 6,997,449 | B2 | 2/2006 | Obuchi et al. | |
| 7,011,306 | B2 | 3/2006 | Kato et al. | |
| 8,434,753 | B2 | 5/2013 | Fukatsu et al. | |
| 8,684,346 | B2 | 4/2014 | Yamazaki et al. | |
| 2006/0170149 | A1* | 8/2006 | Seto | 271/240 |
| 2008/0284092 | A1* | 11/2008 | Suzuki et al. | 271/244 |
| 2014/0320940 | A1 | 10/2014 | Ino et al. | |

* cited by examiner 300
100
332
DOCUMENT FEEDER CONTROLLER
333
IMAGE READER CONTROLLER
334
IMAGE SIGNAL CONTROLLER
335
PRINTER CONTROLLER
301
CONSOLE SECTION
330
CPU CIRCUIT UNIT
329
CPU
331
ROM
350
RAM
336
FINISHER CONTROLLER
550
CPU
551
ROM
552
RAM
101
SKEW SENSOR
104
LATERAL POSITION SENSOR
210
SHIFT UNIT-MOVING MOTOR
211
SENSOR SHIFT MOTOR
M340
SECOND ALIGNMENT DRIVE MOTOR
M341
FIRST ALIGNMENT DRIVE MOTOR
208
SHIFT CONVEYING MOTOR

SHEET PROCESSING APPARATUS THAT ALIGNS SHEETS AND IMAGE FORMING SYSTEM

BACKGROUND OF THE INVENTION

1. Field of the Invention

The present invention relates to a sheet processing apparatus that performs post-processing on sheets, and an image forming system including the sheet processing apparatus.

2. Description of the Related Art

Conventionally, there has been known a sheet processing apparatus that performs post-processing on sheets output from an image forming apparatus. Examples of this type of sheet processing apparatus include one that stacks sheets on a processing tray, aligns the sheets by pushing lateral edges thereof by alignment members, and then performs post-processing, such as stapling processing, on the sheets.

By the way, conventionally, there has been known an image forming apparatus that corrects skew of sheets using alignment members (Japanese Patent Laid-Open Publication No. 2005-42342). This image forming apparatus is equipped with a sensor for detecting a skew amount of sheets, and correcting the skew of a sheet entering between the alignment members based on the detection results sent from the sensor. When the skew amount of the sheet is not smaller than a predetermined amount, the alignment members for correcting the skew are largely retracted to thereby reduce damage to the sheet caused by collision of the sheet with the alignment members.

In the above-described apparatus, however, since the alignment members are each retracted over a shift distance large enough to avoid the collision, the shift distance over which the alignment members are moved each time becomes large, and hence it takes longer time (alignment time) to perform the correction of skew. As a consequence, there is a fear that it is impossible to complete the alignment before the next conveyed sheet arrives, resulting in jamming of the sheet. On the other hand, if a sufficiently long time period is secured for an interval at which each sheet is conveyed so as to cope with the long alignment time, the productivity of image formation and post-processing is reduced.

SUMMARY OF THE INVENTION

The present invention provides a sheet processing apparatus and an image forming system which are capable of shortening alignment time taken to align sheets.

In a first aspect of the present invention, there is provided a sheet processing apparatus comprising a first alignment member and a second alignment member that can be moved in a sheet width direction orthogonal to a sheet conveying direction, for aligning a sheet, a moving unit configured to move each of the first alignment member and the second alignment member in the sheet width direction, a detection unit configured to detect a skew amount and a skew direction of the sheet, and a control unit configured to control the moving unit to position the first and second alignment members at respective predetermined standby positions before the sheet is received between the first alignment member and the second alignment member, and move one of the first alignment member and the second alignment member in a direction toward the sheet during conveyance of the sheet between the first alignment member and the second alignment member, based on the skew amount and skew direction detected by the detection unit.

In a second aspect of the present invention, there is provided an image forming apparatus including a sheet processing apparatus, and an image forming apparatus that is connected to the sheet processing apparatus, and discharges a sheet having an image formed thereon into the sheet processing apparatus, wherein the sheet processing apparatus comprises a first alignment member and a second alignment member that can be moved in a sheet width direction orthogonal to a sheet conveying direction, for aligning a sheet, a moving unit configured to move each of the first alignment member and the second alignment member in the sheet width direction, a detection unit configured to detect a skew amount and a skew direction of the sheet, and a control unit configured to control the moving unit to position the first and second alignment members at respective predetermined standby positions before the sheet is received between the first alignment member and the second alignment member, and move one of the first alignment member and the second alignment member in a direction toward the sheet during conveyance of the sheet between the first alignment member and the second alignment member, based on the skew amount and skew direction detected by the detection unit.

According to the present invention, it is possible to shorten time to align sheets.

Further features of the present invention will become apparent from the following description of exemplary embodiments (with reference to the attached drawings).

DESCRIPTION OF THE EMBODIMENTS

The present invention will now be described in detail below with reference to the accompanying drawings showing embodiments thereof.

Figure 1:
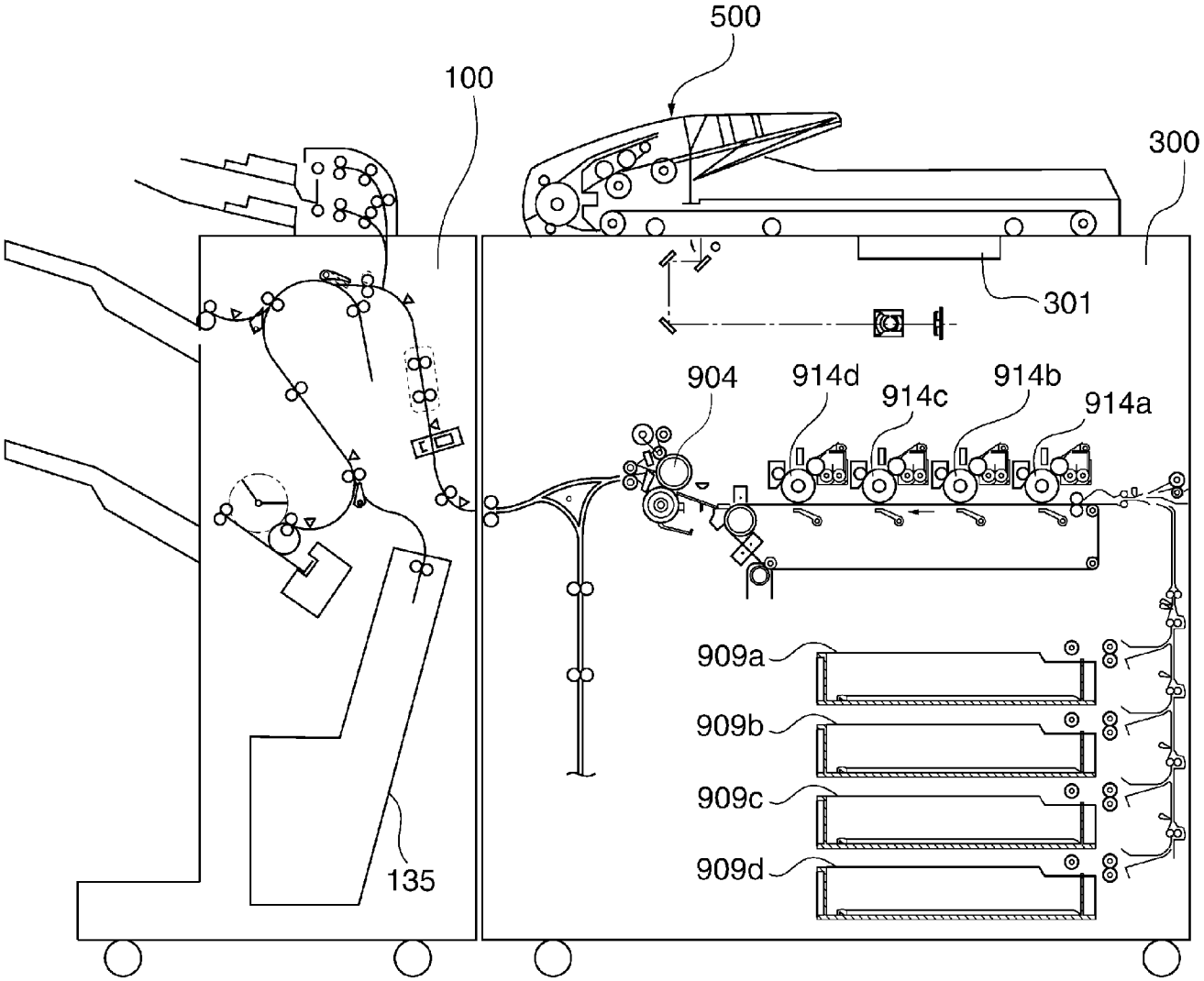
FIG. 1 is a schematic longitudinal cross-sectional view of an image forming system comprised of a sheet processing apparatus and an image forming apparatus, according to an embodiment of the present invention.

FIG. 1 is a schematic longitudinal cross-sectional view of an image forming system comprised of a sheet processing apparatus and an image forming apparatus, according to an embodiment of the present invention.

The image forming system is comprised of the image forming apparatus 300 that forms black-and-white and color images, and a finisher 100, as the sheet processing apparatus, which is communicably connected to the image forming apparatus 300.

The image forming apparatus 300 includes yellow, magenta, cyan, and black photosensitive drums 914*a*, 914*b*, 914*c*, and 914*d*, a fixing device 904, and cassettes 909*a* to 909*d* for accommodating sheets. After toner images of the four colors are transferred onto a sheet fed from one of the cassettes 909*a* to 909*d*, by the photosensitive drums 914*a*, 914*b*, 914*c*, and 914*d*, and so forth, the sheet is conveyed to the fixing device 904, where the toner images are fixed on the sheet. Then, the sheet is discharged out of the image forming apparatus 300.

The finisher 100 includes a saddle-stitching unit (hereinafter referred to as the "saddle unit") 135 and a side-stitching unit (not shown). Sheets discharged from the image forming apparatus 300 and conveyed into the finisher 100 are processed on-line within the finisher 100. Note that the finisher 100 is sometimes used as an option. Therefore, the image forming apparatus 300 can also be used singly. Further, the finisher 100 and the image forming apparatus 300 may be integrally formed with each other.

The image forming apparatus 300 includes a console section 301. In the illustrated example, a rear side of the image forming apparatus 300 (far side in FIG. 1) is referred to as the "far side", which is a first side. On the other hand, a side of the image forming apparatus 300 where a user makes various inputs or settings via the console section 301 is a front side of the image forming apparatus 300 (near side in FIG. 1). This side is referred to as the "near side", which is a second side. Thus, FIG. 1 shows the image forming apparatus 300, as viewed from the near side. The finisher 100 is connected to the left side of the image forming apparatus 300. The terms of "near side and far side" are also commonly used for the finisher 100.

Figure 2:
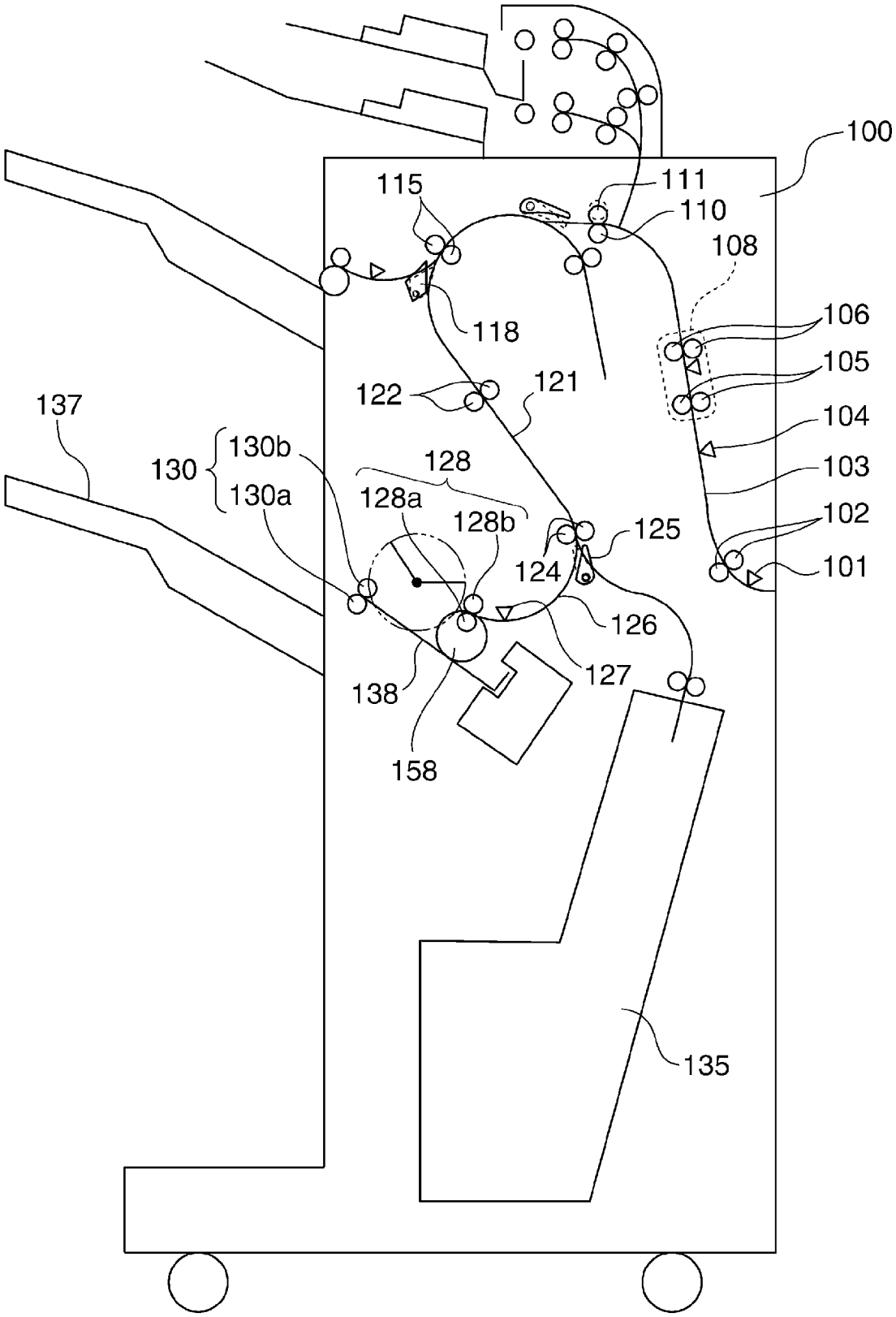
FIG. 2 is a longitudinal cross-sectional view of a finisher appearing in FIG. 1, as viewed from a near side.

FIG. 2 is a longitudinal cross-sectional view of the finisher 100, as viewed from the near side.

A sheet discharged from the image forming apparatus 300 is passed to an inlet roller pair 102 of the finisher 100. At this time, a skew of the sheet is also detected simultaneously by a skew sensor 101. As the sheet conveyed by the inlet roller pair 102 passes through a conveying path 103, positions of lateral edges, i.e. side edges, of the sheet are detected by a lateral position sensor 104. As a consequence, an amount of misalignment (registration deviation in a lateral direction: hereinafter referred to as the "lateral misalignment") of a sheet with respect to a conveying reference position in a sheet width direction is detected. Here, out of directions on the sheet surface, a direction orthogonal to a sheet conveying direction is the sheet width direction. The lateral edges of the sheet are a side edge on the far side and a side edge on the near side in the sheet width direction.

After the lateral misalignment is detected, a shift unit 108 is shifted toward the near side or the far side during conveyance of the sheet by shift roller pairs 105 and 106, whereby a shift operation of the sheet is performed. This shift operation will be described hereinafter.

After performing the shift operation by the shift of the shift unit 108, the sheet conveyed by a conveying roller 110 and a separation roller 111 is further conveyed by a buffer roller pair 115. The sheet conveyed by the buffer roller pair 115 is guided into a conveying path 121 by an upper path-switching member 118, and is then passed through the conveying path 121, sequentially by a buffer roller pair 122 and a conveying roller pair 124.

When a sheet is to be subjected to saddle-stitching processing, a saddle path-switching member 125 is switched by a drive unit, such as a solenoid, not shown, whereby the sheet conveyed by the conveying roller pair 124 is guided into the saddle unit 135, where it is subjected to saddle-stitching processing.

On the other hand, when a sheet is to be discharged onto a stacking tray 137, the sheet conveyed by the conveying roller pair 124 is guided into a lower path 126 by the saddle path-switching member 125. Thereafter, the sheet is discharged onto a processing tray 138 by a lower discharge roller pair 128 formed by discharge rollers 128*a* and 128*b*. In the processing tray 138, a plurality of sheets are stacked to form a sheet bundle, and the sheet bundle is subjected to stapling processing or the like. Then, the sheet bundle is discharged onto the stacking tray 137 by a discharge roller pair 130 formed by a lower discharge roller 130*a* and an upper discharge roller 130*b*. Note that the aforementioned lower path 126 is provided with a sheet discharge sensor 127.

Next, the arrangement and operation of the shift unit 108 will be described with reference to FIGS. 3 and 4.

Figure 3:
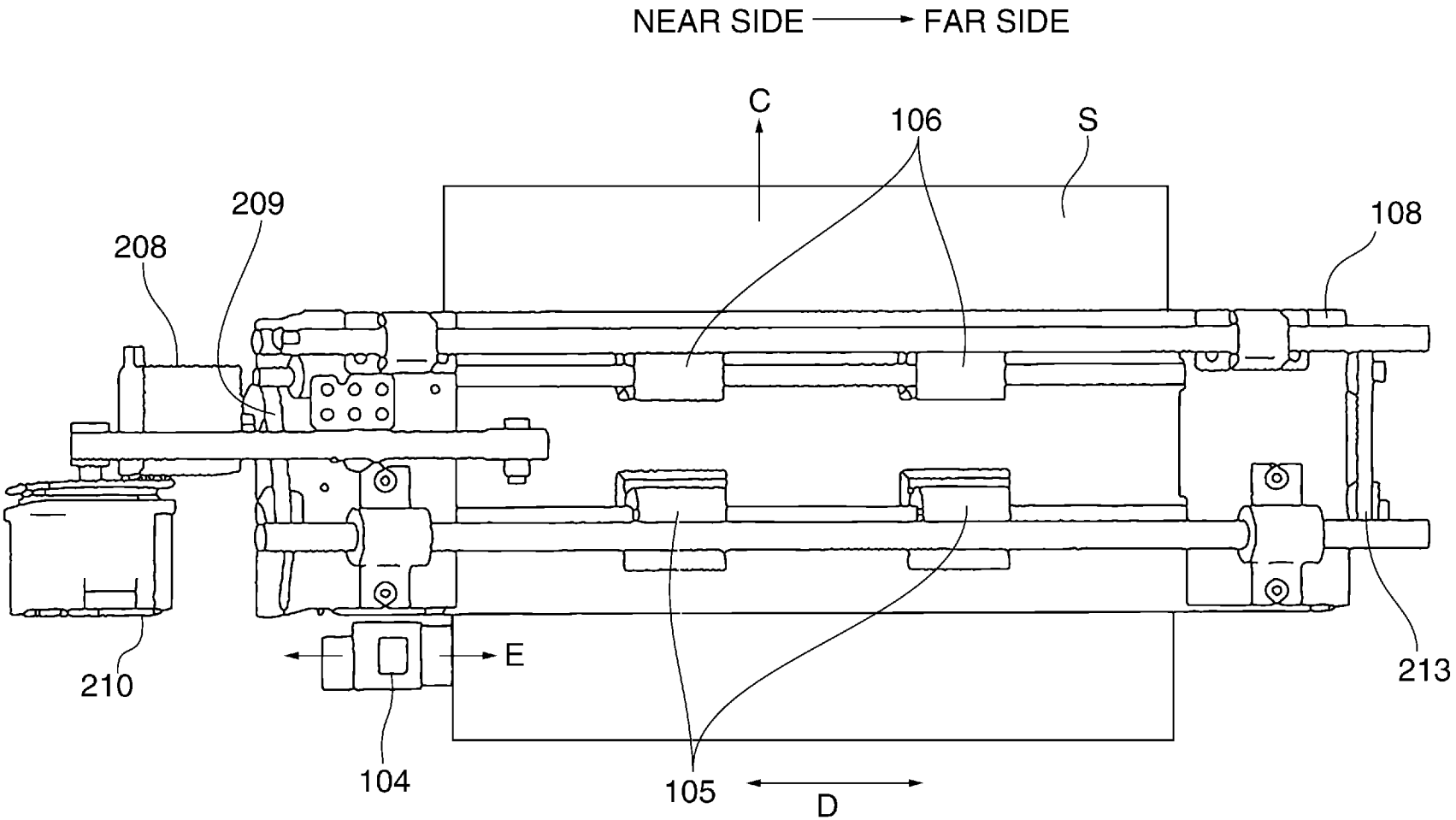
FIG. 3 is a view of a shift unit, as viewed from a direction perpendicular to a sheet conveying direction and a sheet width direction.

FIG. 3 is a view of the shift unit 108, as viewed from a direction perpendicular to the sheet conveying direction and the sheet width direction. FIG. 4 is a perspective view of the shift unit 108.

Figure 4:
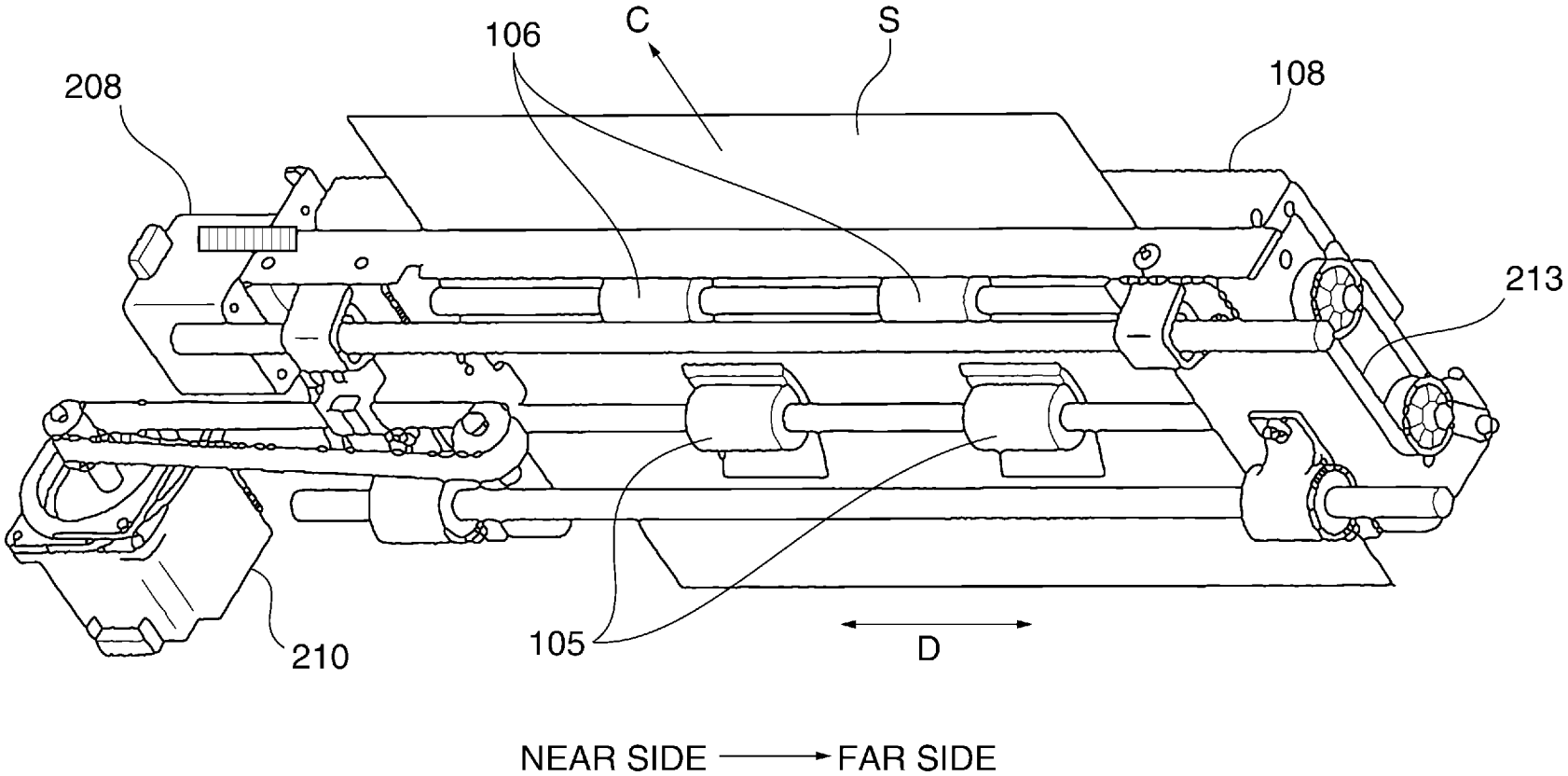
FIG. 4 is a perspective view of the shift unit.

Referring to FIGS. 3 and 4, the shift unit 108 includes the shift roller pairs 105 and 106. When a sheet S is conveyed, a shift conveying motor 208 is driven, and the driving force of the shift conveying motor 208 is transmitted to the shift roller pair 106 via a drive belt 209, whereby the shift roller pair 106 is driven. Further, the driving force of the shift roller pair 106 is transmitted to the shift roller pair 105 via a drive belt 213, whereby the shift roller pair 105 is driven. This causes the sheet S to be conveyed in a C direction.

At this time, the lateral position sensor 104 is driven by a sensor shift motor 211 (FIG. 7), and is shifted in a direction indicated by an arrow E in FIG. 3 (toward the far side), whereby the position of a lateral edge of the sheet S is detected. The shift unit 108 shifts the sheet S during conveyance of the sheet by an amount obtained by adding a shift amount for canceling out a difference between the detected position of the lateral edge of the sheet S and the reference position, and a set shift amount of the sheet S.

Further, when a skew is detected by the skew sensor 101, a shift amount of the sheet S, for canceling out the amount of misalignment of the lateral edge caused by the skew is also added to the shift amount of the sheet S. In this case, the respective positions of the lateral edges of the sheet S are prevented from being caused to interfere with first and second alignment members 341*a* and 340*a* (described hereinafter with reference to FIG. 6), which are plate-shaped alignment members arranged on the processing tray 138, due to the skew. A method of detecting a skew amount and an amount of misalignment will be described in detail hereinafter.

The shift operation is performed by the shift unit 108 being driven by a shift unit-moving motor 210 toward the near side or the far side (direction indicated by an arrow D) with the sheet S being sandwiched between the shift roller pairs 105 and 106. As a consequence, the sheet S is shifted while being conveyed in the conveying direction C. The direction indicated by the arrow E is the same as the direction indicated by the arrow D.

Next, the processing tray 138 will be described with reference to FIGS. 5 and 6.

Figure 5:
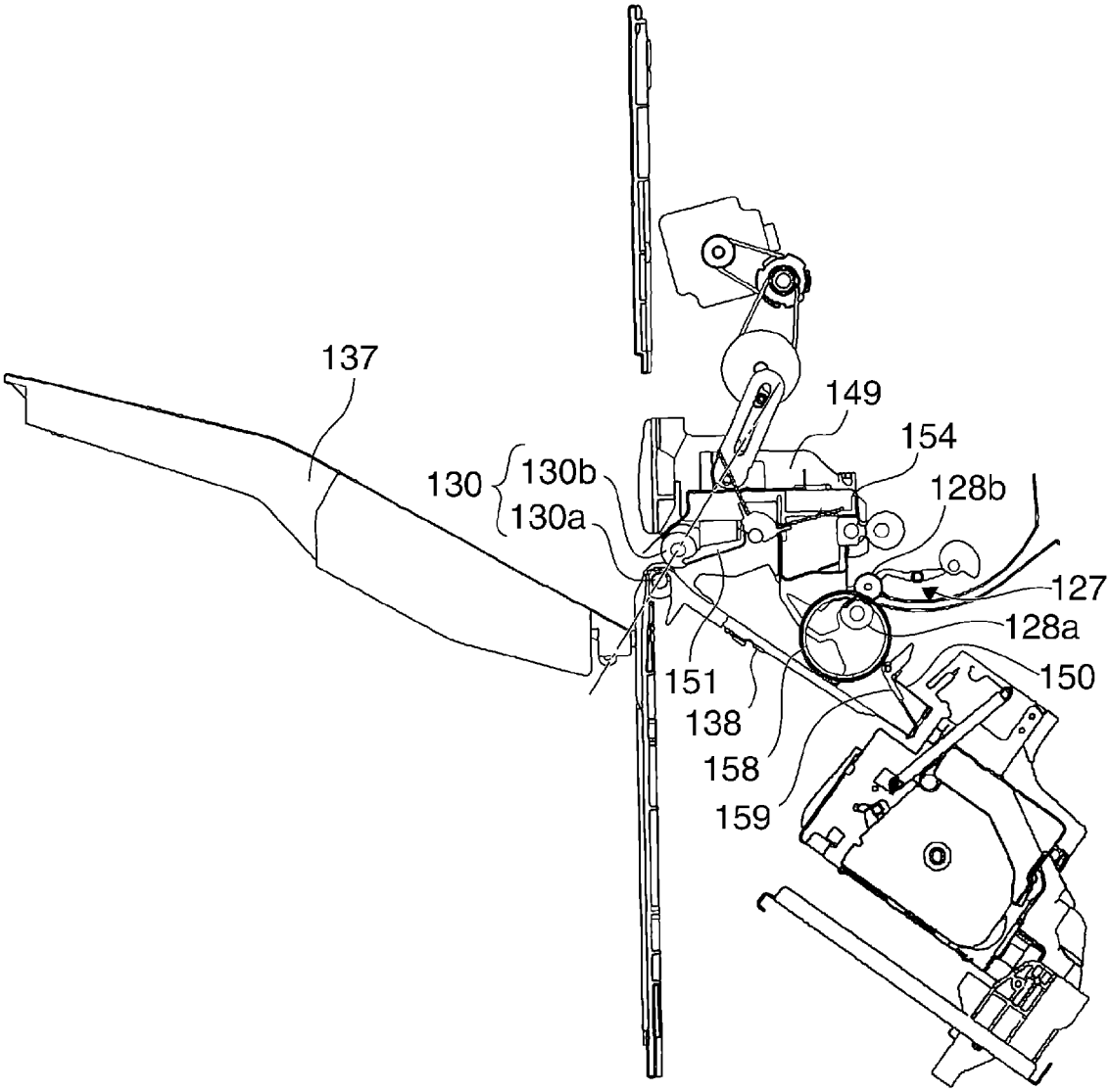
FIG. 5 is a cutaway side view showing a cross-section of a processing tray and associated members.

FIG. 5 is a cutaway side view showing a cross-section of the processing tray 138 and associated members. As shown in FIG. 5, the processing tray 138 is disposed tilted such that the downstream side (left side as viewed in FIG. 5) thereof is positioned upward in a sheet bundle discharging direction and the upstream side (right side as viewed in FIG. 5) thereof is positioned downward. A trailing end stopper 150 is disposed on a lower end, which is an upstream side, of the processing tray 138.

The lower discharge roller 130*a* as one roller of the discharge roller pair 130 is disposed on an upper end, which is a downstream side, of the processing tray 138. The upper discharge roller 130*b* as the other roller of the discharge roller pair 130 is disposed on a lower-surface front end of a swinging guide 149. A guide 151 is axially disposed on the swinging guide 149. The swinging guide 149 is pivotally supported on a support shaft 154 such that it can swing vertically. The guide 151 is located upstream of the upper discharge roller 130*b*, and guides a sheet to a roller nip of the discharge roller pair 130.

The upper discharge roller 130*b* is brought into or out of contact with the lower discharge roller 130*a* in accordance with the closing and opening operation of the swinging guide 149 caused by swing thereof. The discharge roller pair 130 has upper and lower discharge roller shafts driven for rotation by a drive motor (not shown), and is configured to be capable of normal and reverse rotation. This makes it possible for the discharge roller pair 130 to convey the sheet S in an outward discharge direction in which the sheet S is discharged onto the stacking tray 137, and an introducing direction in which the sheet S is conveyed (introduced) into the processing tray 138.

Note that normally, when the sheet S is introduced from the lower path 126 into the processing tray 138, the swinging guide 149 swings upward, whereby the upper discharge roller 130*b* is brought out of contact with the lower discharge roller 130*a*, which opens the discharge roller pair 130. Further, when processing of a sheet bundle on the processing tray 138 is terminated, the swinging guide 149 is moved downward to cause the upper discharge roller 130*b* and the lower discharge roller 130*a* to sandwich the sheet bundle. After that, the discharge roller pair 130 rotates with the upper discharge roller 130*b* and the lower discharge roller 130*a* sandwiching the sheet bundle, as mentioned above, whereby the sheet bundle is discharged onto the stacking tray 137. Note that in the processing tray 138, stapling processing is performed on a trailing end of the sheet bundle.

Figure 6:
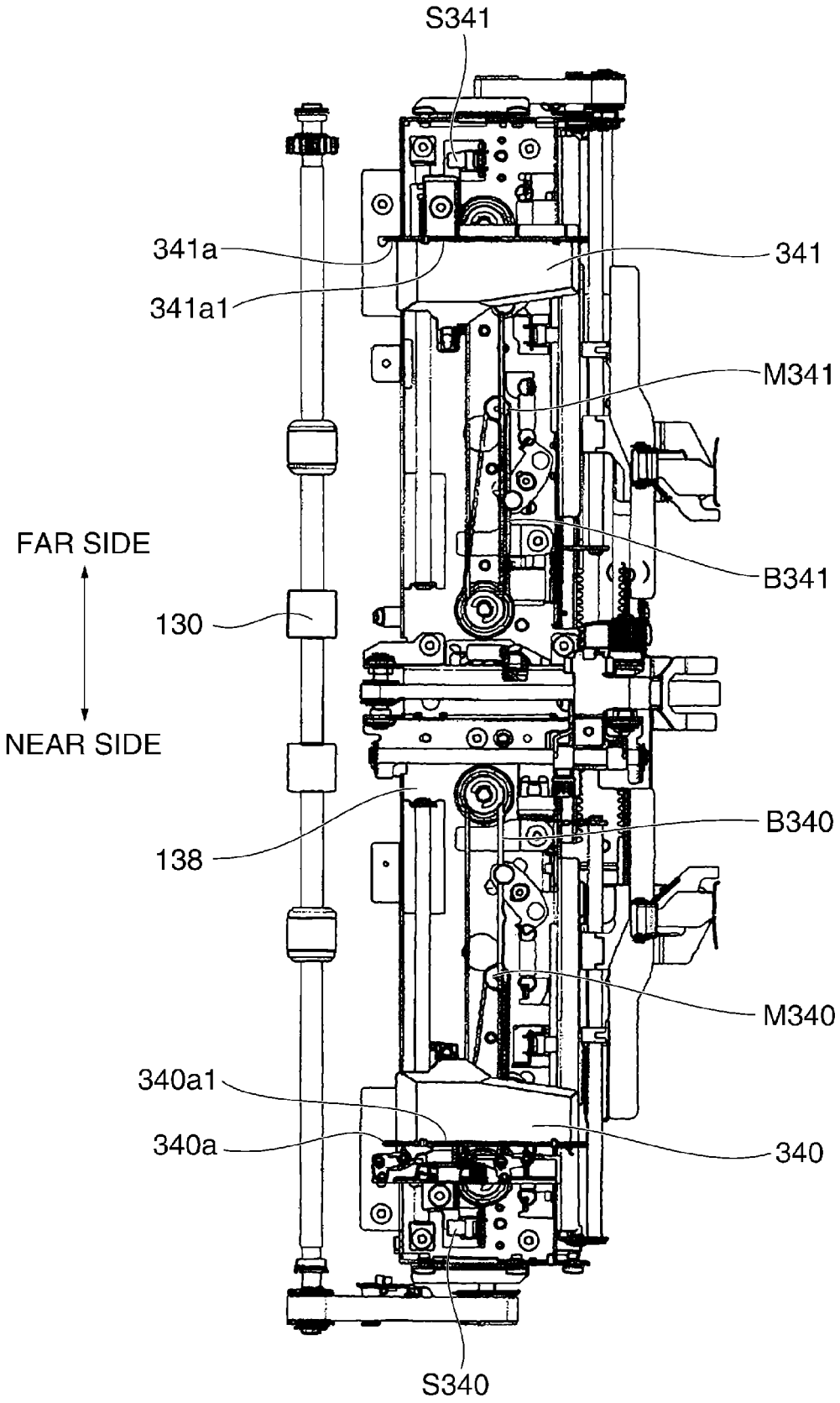
FIG. 6 is a view of the processing tray and the associated members, as viewed from above in FIG. 5.

FIG. 6 is a view of the processing tray 138 and the associated members, as viewed from above in FIG. 5.

The processing tray 138 includes, as alignment sections for aligning the sheet S in the sheet width direction, a first alignment section 341 on the far side and a second alignment section 340 on the near side.

The first and second alignment members 341*a* and 340*a* are erected from the first and second alignment sections 341 and 340. The first and second alignment members 341*a* and 340*a* are wall portions which are perpendicular to the width direction (direction toward the far side) of the sheet S. Respective surfaces of the first and second alignment members 341*a* and 340*a*, which face toward each other, are first and second alignment surfaces 341*a*1 and 340*a*1.

Driving forces of first and second alignment drive motors M341 and M340 are transmitted from front end pulleys thereof to the first and second alignment sections 341 and 340 via timing belts B341 and B340. This enables the first and second alignment sections 341 and 340 to shift independently along the sheet width direction with respect to the processing tray 138. The first and second alignment drive motors M341 and M340 drive the first and second alignment sections 341 and 340, respectively, whereby the first and second alignment members 341*a* and 340*a* are displaced to define the positions of the first and second alignment surfaces 341*a*1 and 340*a*1 and spacing therebetween.

Further, to detect respective home positions of the first and second alignment sections 341 and 340, there are disposed sensors S341 and S340. When the first and second alignment sections 341 and 340 are not in operation, they are kept on standby at the home positions thereof (at opposite ends in FIG. 6).

Next, a description will be given of introduction of a sheet into the processing tray 138.

As to the sheet S introduced into the processing tray 138, an upstream-side end, which is at a lower right location as viewed in FIG. 5, is referred to as the "trailing end", and a downstream-side end, which is at an upper left location as viewed in FIG. 5, is referred to as the "leading end". The ends of the sheet S introduced into the processing tray 138, referred to as the leading end and the trailing end, correspond to the leading end and the trailing end of the sheet S being conveyed on the conveying path 103, the conveying path 121, and the lower path 126.

When the sheet S is introduced into the processing tray 138, the sheet S enters between the first and second alignment members 341*a* and 340*a* with the leading end ahead. After the sheet S starts to be discharged onto the processing tray 138 by the lower discharge roller pair 128, the sheet S is temporarily switched back to be conveyed to the trailing end stopper 150 with the trailing end ahead. The trailing end of the sheet S is brought into contact with the trailing end stopper 150, and then the first and second alignment members 341*a* and 340*a* are moved in a direction in which they become nearer to each other, whereby a lateral edge alignment operation for aligning the lateral edges of the sheet S is performed. The lateral edge alignment operation is performed before stapling processing is performed on the sheet bundle in the processing tray 138.

As shown in FIG. 5, arranged upstream of the processing tray 138 are a belt roller 158 (see FIG. 2 as well) for conveying the sheet S and a trailing end lever 159 for pressing the sheet S.

The sheet S introduced into the processing tray 138 is guided upstream by counterclockwise rotation of the belt roller 158, as viewed in FIG. 5, while being guided by the trailing end lever 159, and is brought into abutment with the trailing end stopper 150, whereby the trailing edge of the sheet S is aligned in the conveying direction.

The belt roller 158 is looped around an outer periphery of the lower discharge roller 128*a* as a component of the lower discharge roller pair 128 as a conveying unit, and is rotated counterclockwise in a manner driven by the rotation of the discharge roller 128*a*. Further, the belt roller 158 is disposed above the processing tray 138 in such a positional relation thereto that a lower portion of the belt roller 158 is in contact with an uppermost sheet stacked on the processing tray 138.

Figure 7:
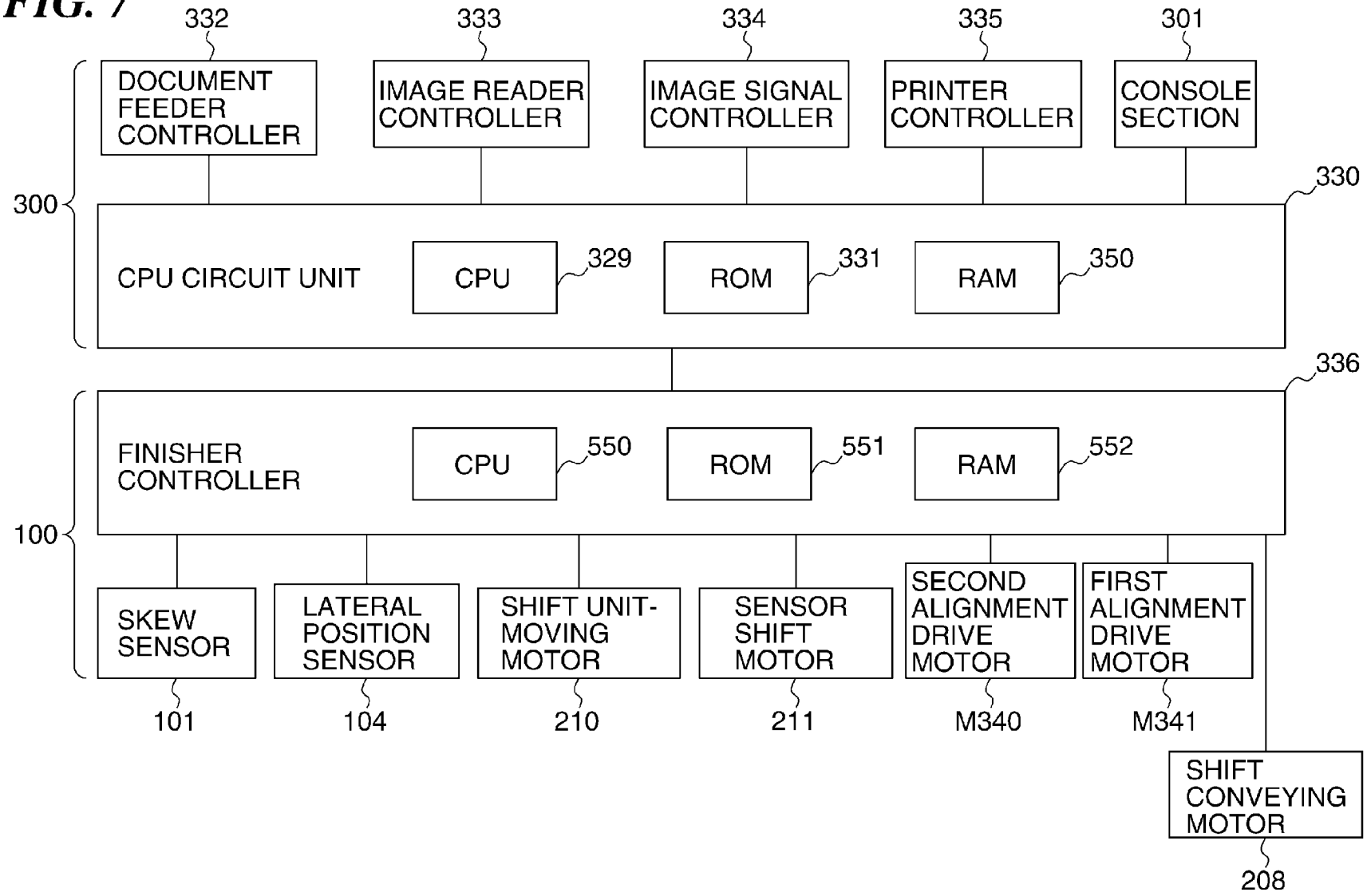
FIG. 7 is a block diagram of a controller for controlling the image forming apparatus and the finisher.

Next, an image forming system controller will be described with reference to FIG. 7. FIG. 7 is a block diagram of a controller for controlling the image forming apparatus 300 and the finisher 100.

First, the image forming apparatus 300 includes a CPU circuit unit 330. The CPU circuit unit 330 incorporates a CPU 329, a ROM 331, and a RAM 350, and performs centralized control of blocks 331, 332, 333, 334, and 335 of the image forming apparatus 300 based on a control program stored in the ROM 331. The RAM 350 temporarily stores control data, and is also used as a work area for arithmetic operations performed according to the control.

Here, a description will be given of the blocks connected to the CPU circuit unit 330. First, the document feeder controller 332 drivingly controls an original feeder 500 (FIG. 1) based on an instruction from the CPU circuit unit 330. The image reader controller 333 drivingly controls a scanner unit, an image sensor, and so forth, of a scanner, and transfers an analog image signal delivered from the image sensor to the image signal controller 334. The image signal controller 334 converts the analog image signal from the image sensor to a digital signal, performs various kinds of processing on the digital signal, converts the processed digital signal to a video signal, and then delivers the video signal to the printer controller 335. The printer controller 335 drives an exposure controller (not shown) based on the video signal delivered from the image signal controller 334. The console section 301 exchanges information with the CPU circuit unit 330. The console section 301 outputs a key signal corresponding to an operation of each key to the CPU circuit unit 330, and displays, based on a signal from the CPU circuit unit 330, corresponding information.

The finisher 100 includes a finisher controller 336. The finisher controller 336 drivingly controls the whole finisher 100 by exchanging information with the CPU circuit unit 330. Note that the finisher controller 336 may be provided in the image forming apparatus 300.

The finisher controller 336 includes a CPU 550, a ROM 551, and a RAM 552, and communicates with the CPU circuit unit 330 of the image forming apparatus 300 via a communication IC (integrated circuit) (not shown) to thereby exchange data therewith. Further, the finisher controller 336 executes various programs stored in the ROM 551 according to instructions from the CPU circuit unit 330 to thereby drivingly control the finisher 100. The finisher controller 336 controls the shift unit-moving motor 210 (FIGS. 3 and 4), the sensor shift motor 211, and the alignment drive motors M340 and M341 (FIG. 6) based on results of detection by the skew sensor 101 and the lateral position sensor 104 (FIG. 2).

Figure 8:
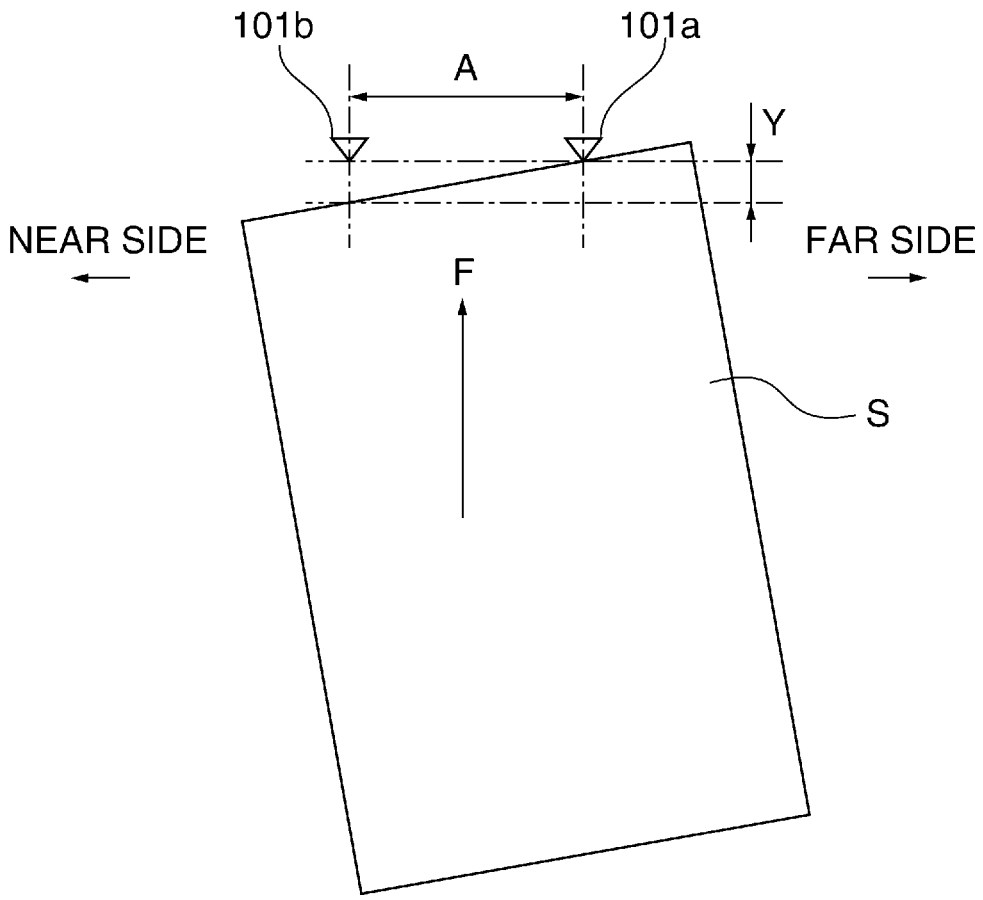
FIG. 8 is a diagram showing a positional relationship between a sheet on a conveying path and a skew sensor.

FIG. 8 is a diagram showing a positional relationship between the sheet S on the conveying path 103 and the skew sensor 101.

The skew sensor 101 detects a direction of inclination of the leading edge (skew direction) and a skew amount of the sheet S conveyed in a conveying direction indicated by an arrow F, and is formed by two sheet sensors 101*a* and 101*b*. The sheet sensors 101*a* and 101*b* are arranged along the direction orthogonal to the conveying direction F. The sheet sensor 101*a* is disposed on the far side, and the sheet sensor 101*b* is disposed on the near side. The sheet sensors 101*a* and 101*b* are arranged with a spacing A smaller than the width of the conveyed sheet S.

A moving distance of the sheet S, which indicates a distance over which the sheet S is moved after one of the sheet sensors 101*a* and 101*b* is turned on until the other is turned on, is measured as the skew amount Y. If the sheet sensor 101*a* is turned on earlier, the skew direction is determined as a far side-advanced skew in which the far side of the sheet is more advanced than the near side of the same, whereas if the sheet sensor 101*b* is turned on earlier, the skew direction is determined as a near side-advanced skew in which the near side of the sheet is more advanced than the far side of the same.

Next, detection of the lateral misalignment will be described with reference to FIGS. 9, 10A and 10B.

Figure 9:
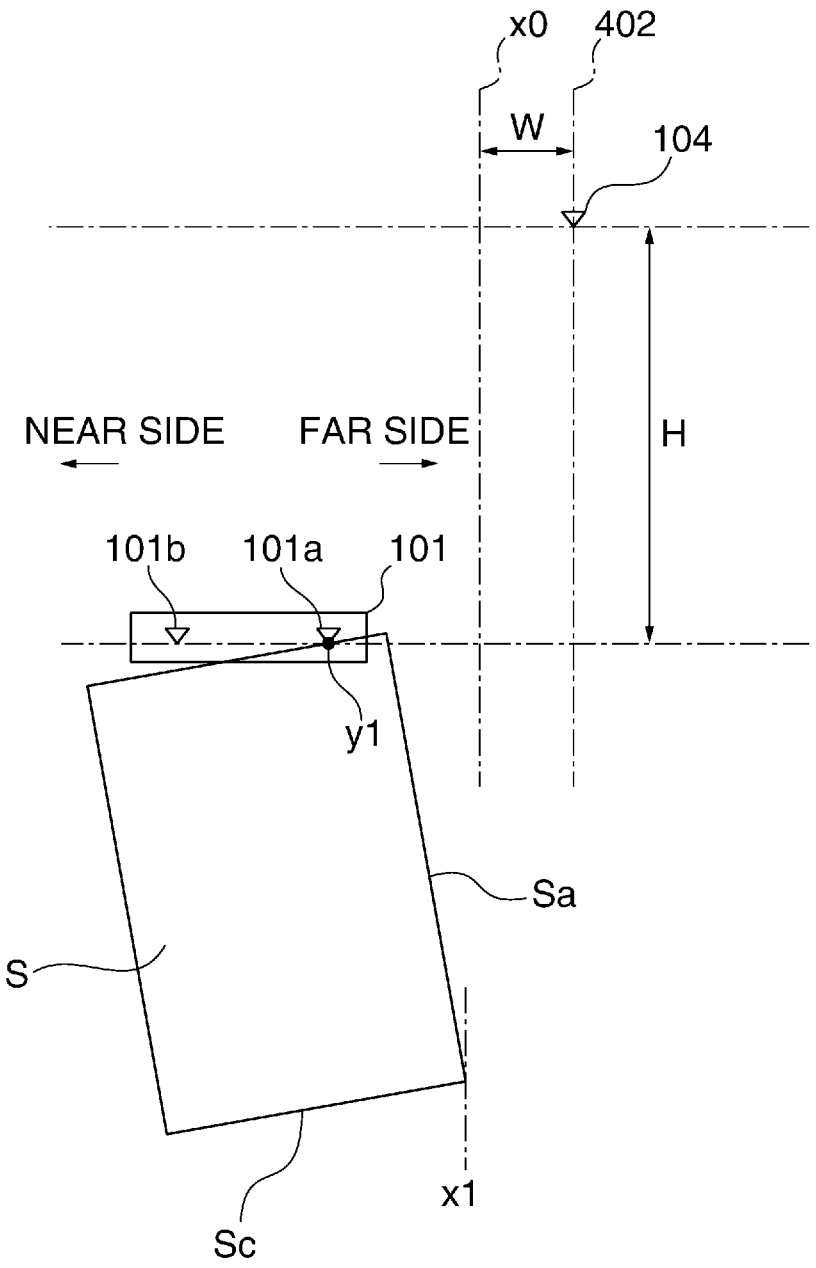
FIG. 9 is a diagram useful in explaining how a skew of a sheet is detected.
Figure 10A:
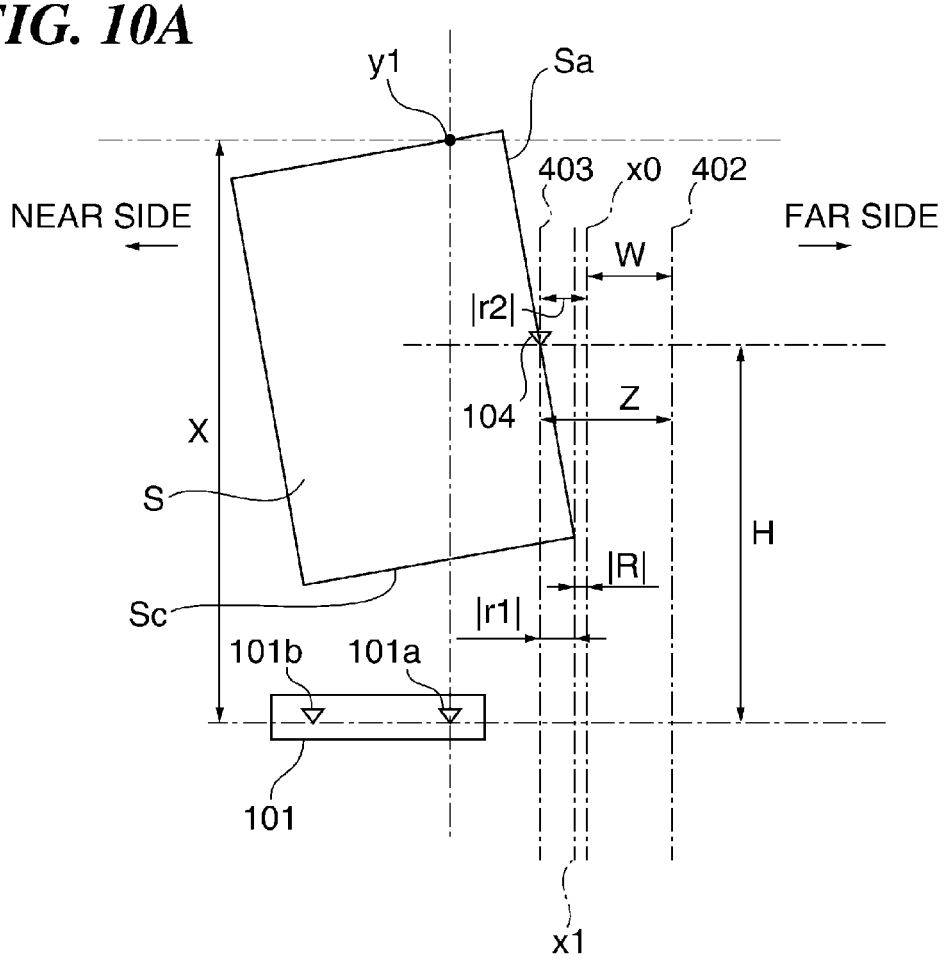
FIGS. 10A and 10B are diagrams useful in explaining how a lateral edge of the sheet is detected.
Figure 10B:
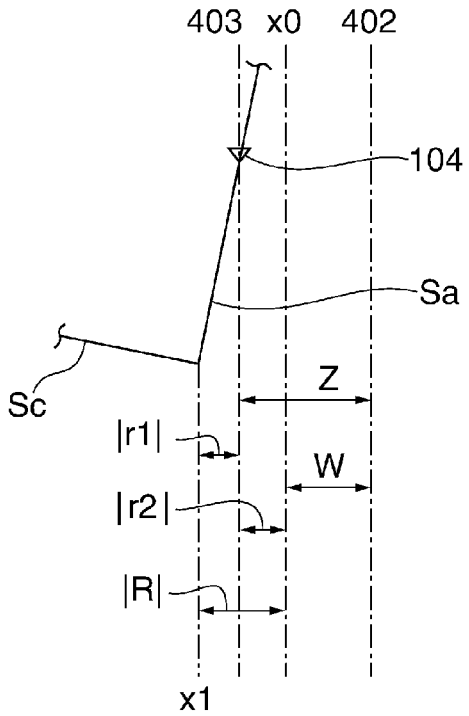

FIGS. 9, 10A and 10B are views useful in explaining how skew detection and lateral edge detection are performed. Particularly, FIG. 9 shows a state of a sheet S at a time point when a leading edge y1 of the sheet S, which is far side-advanced, is detected by the sheet sensor 101*a*. FIG. 10A shows a state of the sheet S at a time point when a far-side lateral edge Sa of the sheet S is detected by the lateral position sensor 104. FIG. 10B is a partial view of a state of the sheet S at a time point when a far-side lateral edge Sa of the sheet S, which is near side-advanced, is detected by the lateral position sensor 104.

The position of a far-side lateral edge of a sheet S in a case where the sheet S has no skew or lateral misalignment is represented by a lateral edge reference position x0.

The lateral misalignment of the sheet S is defined as an amount of misalignment of a trailing edge-side lateral edge position x1 which is a far-side edge position of a sheet trailing edge Sc, with respect to the lateral edge reference position x0. This amount of misalignment is caused by a lateral misalignment of the whole sheet S in the sheet width direction and the skew of the sheet S, and is referred to as the "trailing edge lateral misalignment amount R".

The lateral position sensor 104 is disposed on the far side in the direction orthogonal to the conveying direction F. A standby position 402 of the lateral position sensor 104 is set at a position retracted toward the far side such that even if a postulated largest lateral misalignment occurs in the sheet S, the lateral position sensor 104 is prevented from interfering with the sheet S. That is, the standby position 402 of the lateral position sensor 104 is set at a position spaced from the lateral edge reference position x0 by W toward the far side. The position of the lateral position sensor 104 is grasped with reference to a position where a home position sensor (not shown) has detected the lateral position sensor 104.

As shown in FIG. 9, the lateral position sensor 104 starts to be moved at a time when the sheet leading edge y1 has reached the skew sensor 101. Here, the sheet leading edge y1 is defined as an intersection of the leading edge of the sheet S and one of the sheet sensors 101*a* and 101*b* which has detected the leading edge earlier.

First, let us consider a case where skew detection and lateral edge detection are performed on the far side-advanced sheet S shown in FIGS. 9 and 10A. A moving distance Z of the lateral position sensor 104 is measured over which the lateral position sensor 104 is moved from when it starts to be moved from the standby position 402 to when it reaches a lateral edge detection position 403 where it detects the far-side lateral edge Sa of the sheet S. The moving distance Z is a distance from the standby position 402 to the lateral edge detection position 403 in the sheet width direction.

Next, a sheet conveying distance X is measured over which the sheet S is moved from when the skew sensor 101 detects the sheet leading edge y1 to when the lateral position sensor 104 detects the lateral edge Sa of the sheet S. The length of the sheet S in the sheet conveying direction is represented by L (sheet conveying direction length), and a distance from the skew sensor 101 to the lateral position sensor 104 in the conveying direction is represented by H.

Assuming that the sheet S has a rectangular or square shape, an amount of misalignment in the conveying direction per 1 mm of a lateral width of the sheet S, which is caused by skew, is calculated by Y/A. The trailing edge lateral misalignment amount R in each of the cases of the far side-advanced sheet S and the near side-advanced sheet S is calculated based on the measured moving distance Z and sheet conveying distance X, in the following manner.

First, a lateral misalignment equivalent amount caused by a skew, which is a distance from the lateral edge detection position 403 to the trailing edge-side lateral edge position x1 in the sheet width direction, is represented by r1. Further, a detection position lateral misalignment amount, which is an amount of misalignment of the lateral edge detection position 403 from the lateral edge reference position x0, is represented by r2. In r1 and r2, a sign of + represents misalignment toward the far side, and a sign of − represents misalignment toward the near side. The detection position lateral misalignment amount is calculated by the equation r2=W−Z.

In the case of the far side-advanced sheet S (FIG. 10A), the lateral misalignment equivalent amount r1 is calculated by the following equation (1), whereas in the case of the near side-advanced sheet S (FIG. 10A), r1 is calculated by the following equation (2):

$$r1(\text{far side})=+(L-(X-H))\times Y/A) \quad (1)$$

$$r1(\text{near side})=-(L-(X-H))\times Y/A) \quad (2)$$

Therefore, from the lateral misalignment equivalent amount r1 and the detection position lateral misalignment amount r2, the trailing edge lateral misalignment amount R in the case of the far side-advanced sheet S and the trailing edge lateral misalignment amount R in the case of the near side-advanced sheet S are calculated by the following equations (3) and (4):

$$\begin{aligned} R &= r2 + r1(\text{far side}) \\ &= W - Z + (L - (X - H)) \times Y / A \end{aligned} \quad (3)$$

$$\begin{aligned} R &= r2 + r1(\text{near side}) \\ &= W - Z - (L - (X - H)) \times Y / A \end{aligned} \quad (4)$$

wherein a minus sign of the trailing edge lateral misalignment amount R represents misalignment toward the near side, and a plus sign of the same represents misalignment toward the far side.

FIGS. 11A to 11C and FIGS. 12A to 12C are diagrams showing changes in the position of the far side-advanced sheet S and the near side-advanced sheet S, from the start of introducing a sheet into the processing tray 138 to execution of a lateral edge alignment operation. In each of FIGS. 11A to 11C and FIGS. 12A to 12C, an upward direction is a direction toward the stacking tray 137.

The first alignment member 341*a* of the first alignment section 341 and the second alignment member 340*a* of the second alignment section 340 are associated with the far-side lateral edge Sa of the sheet S and a near-side lateral edge Sb of the sheet S, respectively.

Figure 11A:
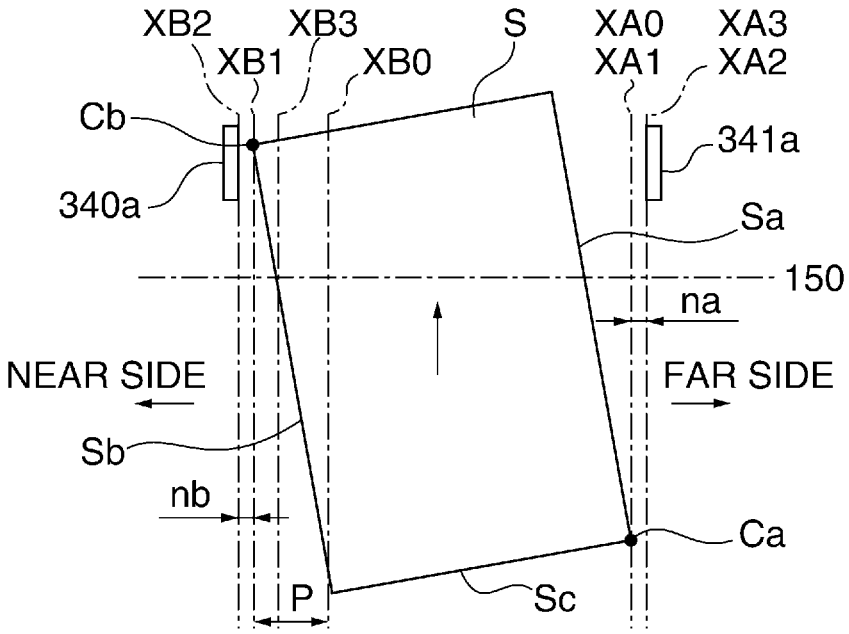
FIGS. 11A to 11C are diagrams showing changes in the position of a far side-advanced sheet, from the start of introducing the sheet into the processing tray to execution of a lateral edge alignment operation.
Figure 11B:
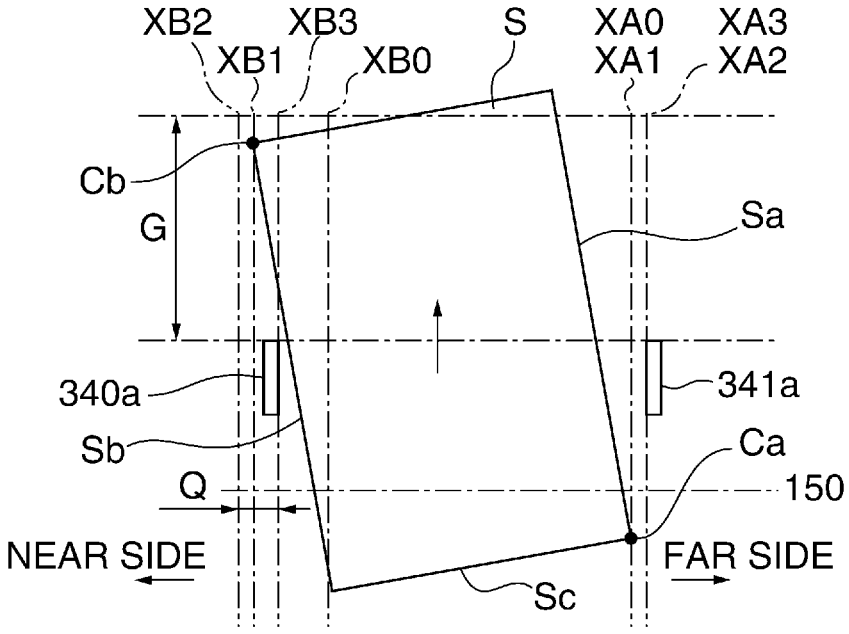
Figure 11C:
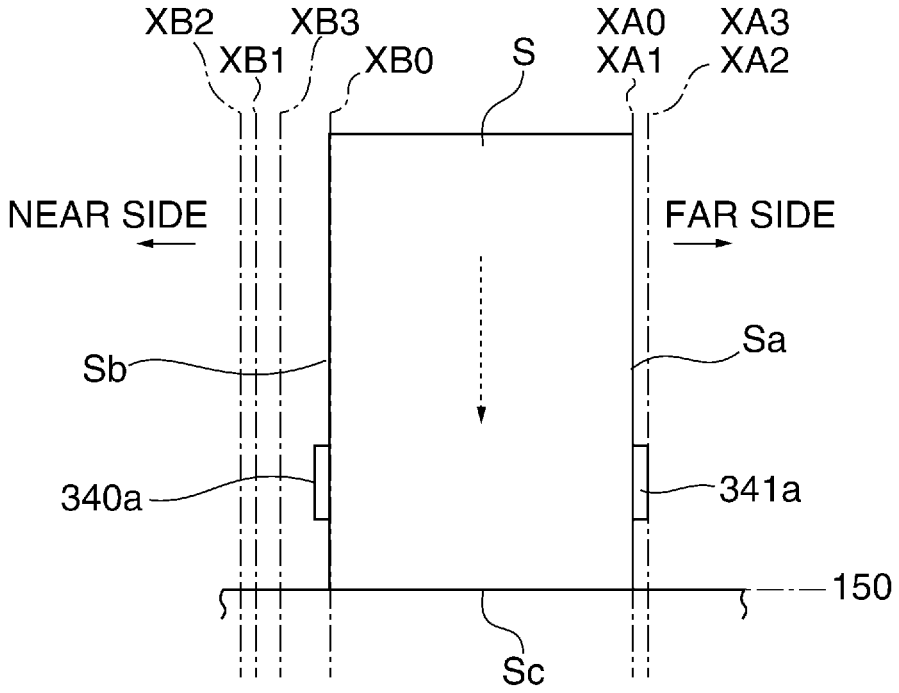
Figure 12A:
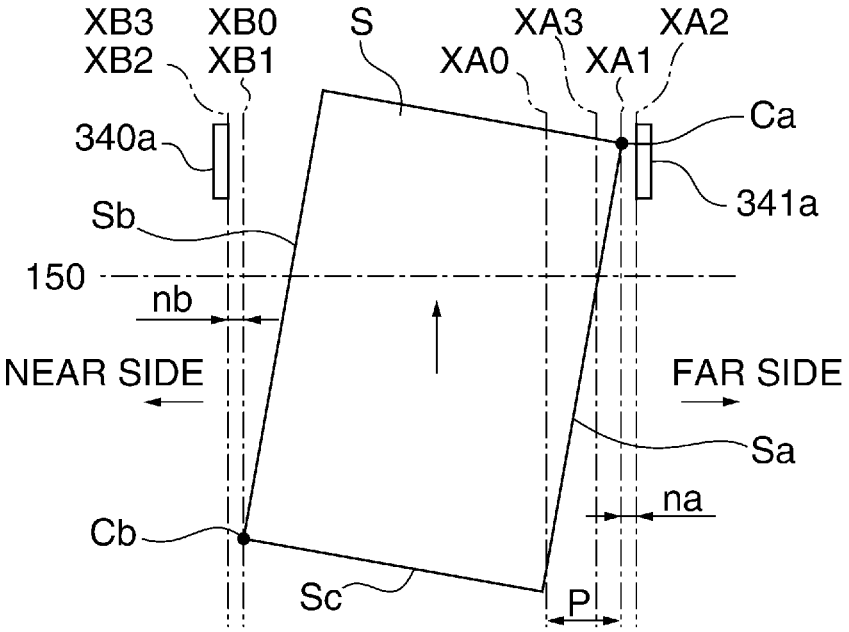
FIGS. 12A to 12C are diagrams showing changes in the position of a near side-advanced sheet, from the start of introducing the sheet into the processing tray to execution of the lateral edge alignment operation.
Figure 12B:
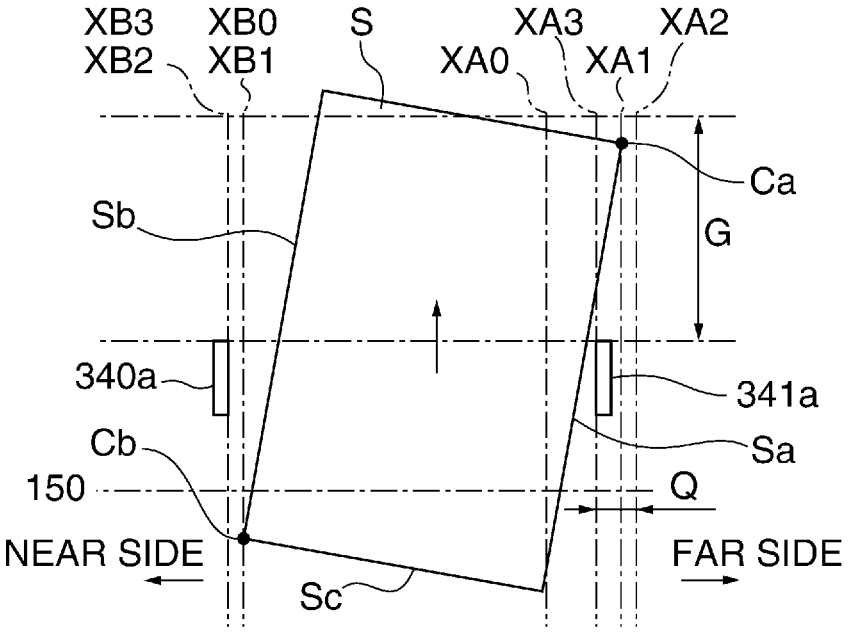
Figure 12C:
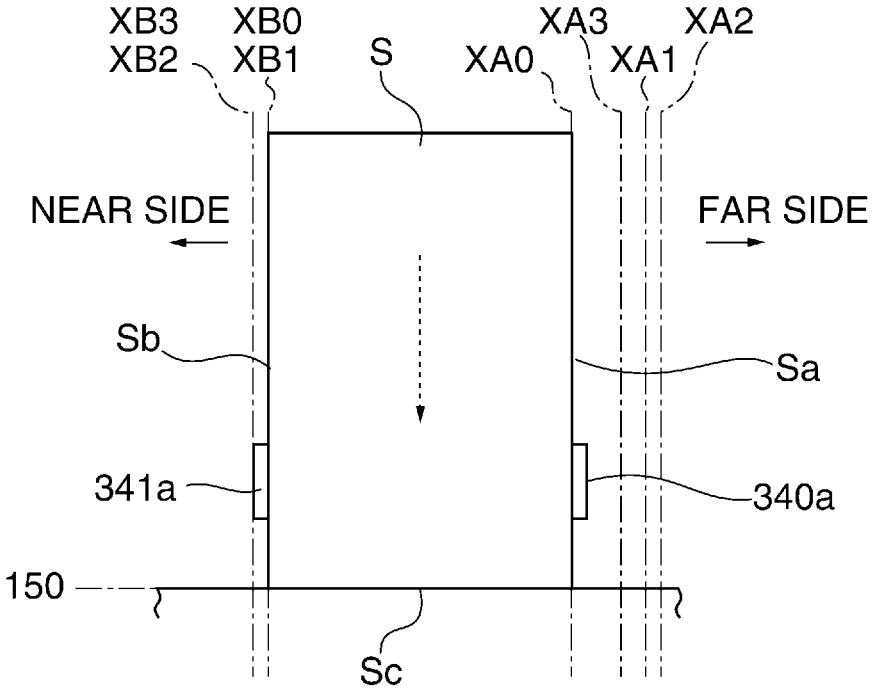

FIGS. 11A and 12A each show a state of the sheet S at a time point when the leading edge of each sheet S to be introduced into the processing tray 138 has entered and been received in between the first and second alignment members 341*a* and 340*a*. FIGS. 11B and 12B show states in which each sheet S has been conveyed from the respective states shown in FIGS. 11A and 12A by a predetermined distance G. The sheet S is moved slightly further from each of the states in FIGS. 11B and 12B in the direction toward the stacking tray 137, and is then, after being switched back so as to advance in the reverse direction, moved in a direction away from the stacking tray 137 (downward, as viewed in FIGS. 11B and 12B) until the sheet S is brought into contact with the trailing end stopper 150. After that, when the trailing edge Sc of the sheet S is brought into contact with the trailing end stopper 150, the lateral edges Sa and Sb are pressed by the lateral edge alignment operation of the first and second alignment members 341*a* and 340*a*, whereby the sheet S is made parallel with the conveying direction (FIGS. 11C and 12C).

First, names of positions (XA, XB) and the like used in FIGS. 11A to 11C and FIGS. 12A to 12C and descriptions given with reference thereto are enumerated as follows:

[Ca, Cb] Out of four corner points of the sheet S, respective corner points protruding toward the far side and the near side in the sheet width direction due to skew (a first corner point Ca and a second corner point Cb)

[XA0, XB0] Respective positions at which the first and second alignment members 341*a* and 340*a* should be located at the time of completion of the lateral edge alignment operation (a first alignment position XA0 and a second alignment position XB0)

[XA1, XB1] Respective positions of the first corner point Ca and the second corner point Cb in the sheet width direction (XA1, XB1)

[XA2, XB2] Respective positions in the sheet width direction at which the first and second alignment members 341*a* and 340*a* should wait when they receive the sheet S therebetween (leading edge receiving positions) (a first standby position XA2 and a second standby position XB2, as predetermined standby positions of the respective alignment members 341*a* and 340*a*)

[XA3, XB3] Respective positions in the sheet width direction at which the first and second alignment members 341*a* and 340*a* should be located when they simultaneously start to be moved to the alignment positions XA0 and XB0 after receiving the sheet S therebetween (alignment start positions XA3 and XB3)

Note that a position of the trailing edge Sc of the sheet S in the sheet width direction, as a reference edge, is corrected by a shift operation of the shift unit 108, before the sheet S is received in between the first and second alignment members 341*a* and 340*a*. Therefore, in the case of the far side-advanced sheet S (FIGS. 11A to 11C), XA0=XA1 holds, and in the case of the near side-advanced sheet S (FIGS. 12A to 12C), XB0=XB1 holds.

By the way, the finisher 100 has the offset stacking function for stacking sheets on the stacking tray 137 in an offset manner. It is assumed that when no instruction for offsetting the sheet S is given, the alignment positions XA0 and XB0 are determined by default.

In the case of the far side-advanced sheet S, as shown in FIG. 11A, a distance P from the known second alignment position XB0 to the position XB1 of the second corner point Cb in the sheet width direction is calculated from the above-mentioned sheet conveying direction length L, skew amount Y, and spacing A by the equation P=L×Y/A. In the case of the near side-advanced sheet S, as shown in FIG. 12A, a distance P from the known first alignment position XA0 to the position XA1 of the first corner point Ca in the sheet width direction is similarly calculated by the equation P=L×Y/A.

The finisher controller 336 determines the first standby position XA2 at a position spaced from the position XA1 of the first corner point Ca in the sheet width direction, toward the far side by a predetermined value na, in both of the case of the far side-advanced sheet S and the case of the near side-advanced sheet S. Further, the finisher controller 336 determines the second standby position XB2 at a position spaced from the position XB1 of the second corner point Cb in the sheet width direction, toward the near side by a predetermined value nb. Since the positions XA1 and XB2 are determined based on the detected skew amount Y and skew direction, the standby positions XA2 and XB2 are determined based on the skew amount Y and the skew direction.

This makes it possible for the sheet S to enter between the first and second alignment members 341*a* and 340*a* without colliding with the same and at the same time with proper safety spacing therefrom, when the sheet S is received therebetween. The predetermined values na and nb are only required to be larger than 0, and the predetermined value na may be equal to the predetermined value nb.

In the case of the far side-advanced sheet S (FIG. 11B), the alignment start position XB3 is calculated as a position displaced from the second standby position XB2 toward the far side by a distance Q. The distance Q is calculated from the skew amount Y and the spacing A by the equation Q=G×Y/A. The alignment start position XA3 is set to the same position as the first standby position XA2.

On the other hand, in the case of the near side-advanced sheet S (FIG. 12B), the alignment start position XA3 is calculated as a position displaced from the first standby position XA2 toward the near side by a distance Q. The distance Q is calculated by the equation Q=G×Y/A. The alignment start position XB3 is set to the same position as the second standby position XB2.

Figure 13:
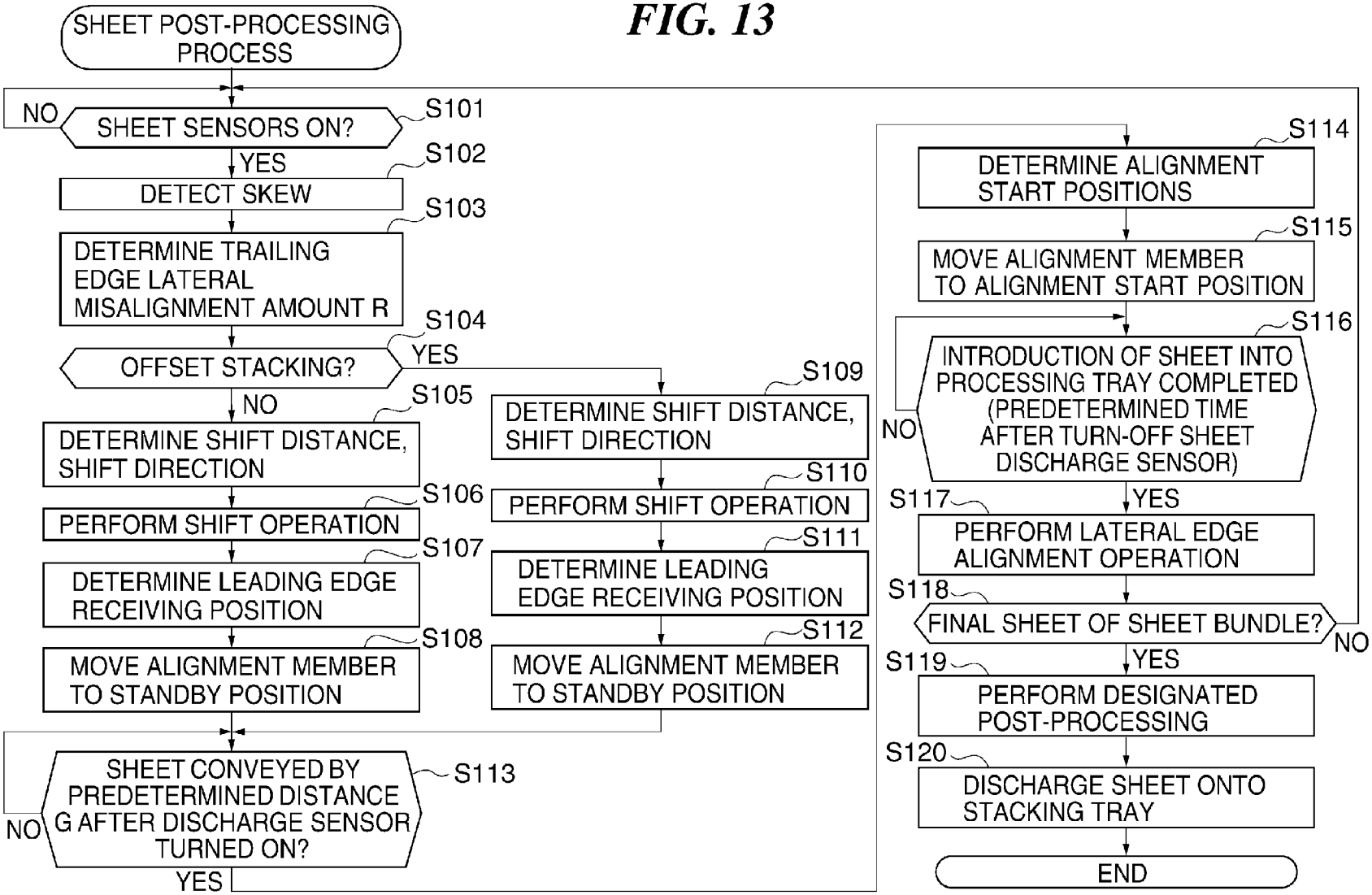
FIG. 13 is a flowchart of a sheet post-processing process.

Next, sheet post-processing process including the lateral edge alignment operation will be described with reference to FIG. 13, while also referring to FIGS. 11A to 11C and FIGS. 12A to 12C, as required. FIG. 13 is a flowchart of the sheet post-processing process. This sheet post-processing process is performed by the CPU 550 on a sheet-by-sheet basis based on a program stored in the ROM 551 of the finisher controller 336.

First, the CPU 550 waits for both the sheet sensors 101*a* and 101*b* forming the skew sensor 101 to be turned on (step S101). If both the sheet sensors 101*a* and 101*b* are turned on, the skew amount Y and the skew direction are detected by the above-described method (corresponding to an operation of a detection unit) (step S102). Next, the CPU 550 determines the trailing edge lateral misalignment amount R by the above-described equations (1) to (4) by taking the skew amount Y and the skew direction into account (step S103).

Next, the CPU 550 determines whether or not an offset stacking mode is designated in which one set of sheet bundle is discharged to a position displaced from an immediately preceding sheet bundle in the sheet width direction (step S104). In the illustrated example, it is assumed that the offset stacking mode is preset by the user using the console section 301. Although an offset amount as an amount of displacement in the sheet width direction set in the offset stacking mode may be a value determined by default, the configuration may be such that the offset amount can be set by the user.

If it is determined in the step S104 that the offset stacking mode is not designated, the CPU 550 determines a shift distance of the shift unit 108 and a shift direction thereof, for the shift operation (step S105). Here, since the offset stacking is not applied, the shift distance of the shift unit 108 is determined as the same value as the trailing edge lateral misalignment amount R. When the trailing edge lateral misalignment amount R takes a negative value, it means that the sheet S is misaligned toward the near side, and hence a direction in which the shift unit 108 should be shifted is toward the far side. When the trailing edge lateral misalignment amount R takes a positive value, it means that the sheet S is displaced toward the far side, and hence the direction in which the shift unit 108 should be shifted is toward the near side.

Next, the CPU 550 controls the shift operation to be performed based on the shift distance and shift direction of the shift unit 108 which are determined in the step S105 (step S106). That is, the CPU 550 causes the shift unit 108 to be shifted by the determined shift distance in the determined shift direction. This sets the position of the trailing edge Sc of the sheet S in the sheet width direction at a position where the trailing edge Sc is to be located when no lateral misalignment occurs. Note that although the position in the sheet width direction is corrected, the skew remains.

Next, the CPU 550 determines leading edge receiving positions at which the respective first and second alignment members 341*a* and 340*a* should wait when they receive the sheet S therebetween, i.e. the first standby position XA2 and the second standby position XB2 (step S107). As described hereinabove, the standby positions XA2 and XB2 are determined as positions spaced from the positions XA1 and XB1 determined from the skew amount Y and the skew direction of the sheet S, by the predetermined values na and nb, respectively.

Then, the CPU 550 controls the first and second alignment members 341*a* and 340*a* to be positioned at the above-described determined standby positions XA2 and XB2, respectively (step S108). More specifically, the CPU 550 drives the first and second alignment drive motors M341 and M340 to thereby move the first and second alignment sections 341 and 340, whereby the first and second alignment members 341*a* and 340*a* are moved to the standby positions XA2 and XB2, respectively (FIGS. 11A and 12A).

On the other hand, if the offset stacking mode is designated in the step S104, the CPU 550 determines the shift distance and the shift direction of the shift unit 108 for the shift operation, by taking the offset amount into account (step S109). Here, since the offset stacking is applied, the shift distance of the shift unit 108 is determined as the sum of the trailing edge lateral misalignment amount R and the offset amount.

For example, when the trailing edge lateral misalignment amount R is +2 mm, and an offset setting is "offset amount of 15 mm toward the near side", the shift distance is 2 mm−15 mm=−13 mm. In this example, since the sign of the value of the shift distance is minus, the shift direction in which the shift unit 108 should be shifted is toward the near side.

Next, the CPU 550 controls the shift operation to be performed based on the shift distance and the shift direction determined in the step S109, similarly to the step S106 (step S110). Then, the CPU 550 determines leading edge receiving positions for receiving the sheet S therebetween, i.e. the first standby position XA2 and the second standby position XB2 (step S111). Here, the standby position XA2 and XB2 are determined similarly to the step S107, but the offset setting is taken into account.

More specifically, when the offset stacking mode is designated, the alignment positions XA0 and XB0 are set to positions displaced from default values in an offset direction by an offset amount. In accordance therewith, the positions XA1, XB1, XA2, and XB2, and further the alignment start positions XA3 and XB3 set later in a step S114, referred to hereinafter, are also determined as positions displaced in the offset direction by the offset amount. Therefore, the positions XA1 and XB1 are determined from the offset amount, the offset direction, and the skew amount Y, and the skew direction of the sheet S. In the step S111, the standby positions XA2 and XB2 are determined as positions spaced from the positions XA1 and XB1 determined by taking the offset value into account as described above, by the predetermined values na and nb, respectively.

Then, similarly to the step S108, the CPU 550 controls the first and second alignment members 341*a* and 340*a* to be positioned at the above-described determined standby position XA2 and XB2, respectively (step S112) (FIGS. 11A and 12A).

After execution of the step S108 or S112, the process proceeds to a step S113, wherein the CPU 550 waits for the sheet S to be conveyed by the predetermined distance G after the sheet discharge sensor 127 is turned on.

Here, the CPU 550 actually determines based on the rotational speed of a motor (not shown) for driving the lower discharge roller pair 128 whether or not conveyance of the sheet S by the predetermined distance G has been completed, depending on whether or not a time period corresponding to the conveyance of the sheet S by the predetermined distance G has elapsed after the sheet discharge sensor 127 is turned on. The time period is supposed to be a time period taken to convey the sheet S by the predetermined distance G after the leading edge of the sheet S has passed through the positions of the first and second alignment members 341*a* and 340*a*. In FIGS. 11B and FIGS. 12B, a conveying distance over which the sheet is conveyed from when the sheet discharge sensor 127 is turned on to when the distance from the front end position of the alignment member (341*a*, 340*a*) to the leading edge of the sheet S becomes a value G is the predetermined distance G. Note that a sensor for actually measuring the predetermined distance G may be provided.

In the step S113, if the conveyance of the sheet S by the predetermined distance G is completed after the turn-on of the sheet discharge sensor 127, the CPU 550 determines the alignment start positions XA3 and XB3 (step S114).

When considering the relationship between the standby positions of the alignment member 341*a* and the alignment member 340*a* and the alignment positions of the same, if the distance from the standby position to the alignment position of one of the alignment member 341*a* and the alignment member 340*a* is larger than that of the other, it takes the one a longer conveyance time period to be moved to the alignment position.

For example, in the case of the far side-advanced sheet S (FIG. 11A), the distance of the second alignment member 340*a* is larger than that of the first alignment member 341*a* (XB2−XB0>XA2−XA0). Here, during the conveyance of the sheet S by the predetermined distance G after the leading edge of the sheet S has been received between the first and second alignment members 341*a* and 340*a*, the second alignment member 340*a* of which the distance is larger can be moved to become closer to the lateral edge Sb. Therefore, by causing the second alignment member 340*a* the distance of which is larger to start to be moved earlier than the first alignment member 341*a*, whereby a whole time period required for the alignment is reduced.

From this view point, the predetermined distance G is required to have a value enough to cause the second corner point Cb to pass beyond the second alignment member 340*a*, and desirably, it is approximately half of the sheet conveying direction length L. As for the first alignment member 341*a* the distance of which is smaller, the alignment start position XA3 is set to the same position as the first standby position XA2, as described above.

In a step S115 in FIG. 13, the CPU 550 controls the first and second alignment members 341*a* and 340*a* to be moved to the determined alignment start positions XA3 and XB3, respectively. In the case of the far side-advanced sheet S, the first alignment member 341*a* is not moved, and only the second alignment member 340*a* is moved to the alignment start position XB3.

In the case of the near side-advanced sheet S, inversely, as for the second alignment member 340*a* the distance of which is smaller, the alignment start position XB3 determined in the step S114 is set to the same position as the second standby position XB2, as described above (FIG. 12B). Further, it is the first alignment member 341*a* that starts to be moved from the standby position earlier.

More specifically, the CPU 550 causes one of the first alignment member 341*a* and the second alignment member 340*a* to be moved in a direction toward the sheet, during conveyance of the sheet S between the first and second alignment members 341*a* and 340*a*, and inhibits the other from being moved.

In a step S116, the CPU 550 waits until introduction of the sheet S to be processed this time into the processing tray 138 has been completed. Determination of whether or not the introduction has been completed is performed based on whether or not a predetermined time period has elapsed after the turn-off of the sheet discharge sensor 127. This is because if the predetermined time period has elapsed after the turn-off of the sheet discharge sensor 127, it can be judged that the sheet S has already been switched back within the processing tray 138, and is being conveyed to the trailing end stopper 150 or has been brought into contact with the trailing end stopper 150.

If the introduction of the sheet S into the processing tray 138 has been completed, the CPU 550 performs the lateral edge alignment operation (step S117). More specifically, the CPU 550 controls the first and second alignment members 341*a* and 340*a* to be moved from the alignment start positions XA3 and XB3 in a direction in which the spacing between the first and second alignment members 341*a* and 340*a* is reduced, and be stopped at the alignment positions XA0 and XB0, respectively. One of the first and second alignment members 341*a* and 340*a*, of which the distance from the standby position to the alignment position is larger, is controlled to restart movement from the alignment start position. With this control, the skew of the sheet S is corrected, and the lateral edge position is properly aligned (FIGS. 11C and 12C).

Next, the CPU 550 determines whether or not the sheet S aligned this time is a final sheet of a sheet bundle (step S118). If the sheet S is not the final sheet of the sheet bundle (NO to the step S118), the process returns to the step S101, wherein a next sheet S to be added to the same bundle is subjected to the sheet post-processing process.

On the other hand, if the sheet S aligned this time is the final sheet of the sheet bundle (YES to the step S118), the CPU 550 controls the sheet bundle to be subjected to the designated post-processing (step S119). Then, the post-processed sheet bundle is discharged onto the stacking tray 137 (step S120). Discharge of the sheet bundle onto the stacking tray 137 is performed by lowering the swinging guide 149, sandwiching the sheet bundle by the upper discharge roller 130*b* and the lower discharge roller 130*a*, and conveying the sheet bundle.

According to the present embodiment, the amounts of retraction of the first and second alignment members 341*a* and 340*a* for receiving a sheet S therebetween are determined according to the skew amount Y and skew direction of the sheet to be received between the first and second alignment members 341*a* and 340*a*. More specifically, before the sheet is received, standby positions XA2 and XB2 for the sheet are determined, and the first and second alignment members 341*a* and 340*a* wait at the standby positions. This makes it possible to set the spacing between the first and second alignment members 341*a* and 340*a* as narrow as possible insofar as there is no fear of causing the sheet S to collide with the first and second alignment members 341*a* and 340*a*. Since there is no need to secure an unnecessarily wide spacing therebetween, the distances over which the first and second alignment members 341*a* and 340*a* are required to be moved for the lateral edge alignment operation are made smaller, whereby the lateral edge alignment operation is efficiently performed. Therefore, by causing the alignment members to wait at positions dependent on the skew of the sheet, it is possible to reduce time taken to achieve alignment by the lateral edge alignment operation.

Further, after the leading edge of the sheet S has passed the positions of the first and second alignment members 341*a* and 340*a*, one of the alignment members, of which the distance to the alignment position is larger, starts to be moved earlier. Therefore, as for the alignment member, of which the distance to the alignment position is larger, the associated one of the alignment start positions XA3 and XB3, from which the first and second alignment members 341*a* and 340*a* simultaneously start to be moved toward the alignment positions XA0 and XB0, is made closer to the associated one of the alignment positions XA0 and XB0 than the associated one of the standby positions XA2 and XB2 is. This makes it possible to further reduce time required for the lateral edge alignment operation.

Note that although in the above-described embodiment, the trailing edge of the sheet is used as a reference edge in the sheet conveying direction, with reference to which the correction is performed by the shift operation, this is not limitative. For example, in a case where the stapling processing is performed on the leading end of a sheet bundle or the like case, the leading edge may be used as a reference edge. Further, although in the above-described embodiment, the trailing edge of the sheet S is brought into contact with the trailing end stopper 150 in the processing tray 138 to cause the sheet S to be aligned in the conveying direction, this is not limitative, but the leading edge of the sheet S received between the first and second alignment members 341*a* and 340*a* may be caused to be brought into contact with some stopper.

Note that it is only required to perform the lateral edge alignment operation on the sheet S by moving the first and second alignment members 341*a* and 340*a* to the alignment positions XA0 and XB0 in a state having the sheet S received between the first and second alignment members 341*a* and 340*a*. Therefore, the sheet S is not necessarily required to be switched back after having been received between the first and second alignment members 341*a* and 340*a*.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2013-272389 filed Dec. 27, 2013 which is hereby incorporated by reference herein in its entirety.

What is claimed is:

1. A sheet processing apparatus comprising:

a first alignment member and a second alignment member, each movable in a sheet width direction orthogonal to a sheet conveying direction, for aligning a sheet;

a moving unit configured to move each of said first alignment member and said second alignment member in the sheet width direction;

a detection unit configured to detect a skew amount and a skew direction of a sheet; and a control unit configured to control said moving unit to position said first alignment member and said second alignment member at respective predetermined standby positions before the sheet is received between said first alignment member and said second alignment member, and move one of said first alignment member and said second alignment member in a direction toward the sheet during conveyance of the sheet between said first alignment member and said second alignment member, based on the skew amount and skew direction detected by said detection unit.

2. The sheet processing apparatus according to claim 1, wherein said control unit determines the one of said first alignment member and said second alignment member which is to be moved by said moving unit in the direction toward the sheet, based on the skew direction detected by said detection unit.

3. The sheet processing apparatus according to claim 1, wherein said control unit causes said moving unit to move the one of said first alignment member and said second alignment member in the direction toward the sheet, after one of ends of the sheet in the conveying direction, on a side where the sheet enters between said first alignment member and said second alignment member earlier, has passed positions of said first alignment member and said second alignment member in the conveying direction.

4. The sheet processing apparatus according to claim 1, wherein said control unit does not change a position of the other of said first alignment member and said second alignment member, during the conveyance of the sheet between said first alignment member and said second alignment member.

5. The sheet processing apparatus according to claim 1, wherein after a first end of opposite ends of the sheet in the conveying direction, the first end entering earlier between said first alignment member and said second alignment member, has passed positions of said first and second alignment members in the conveying direction, said control unit controls said moving unit such that one of said first and second alignment members, of which a distance from the predetermined standby position to the alignment position where the alignment member should be located at a time of completion of alignment is larger, starts to be moved from the predetermined standby position to the alignment position earlier than the other of said first alignment member and said second alignment member, of which a distance from the predetermined standby position to the alignment position is smaller.

6. The sheet processing apparatus according to claim 5, wherein when the sheet is conveyed by a predetermined distance after the first end has passed the positions of said first alignment member and said second alignment member in the conveying direction, said control unit controls said moving unit to move the one of said first alignment member and said second alignment member, of which the distance is larger, from the predetermined standby position to a second standby position closer to the alignment position.

7. The sheet processing apparatus according to claim 6, wherein after the one of said first alignment member and said second alignment member, of which the distance is larger, has been moved to the second standby position, said control unit controls said moving unit to cause the one of said first alignment member and said second alignment member, of which the distance is larger, to restart to be moved from the second standby position to the alignment position, and at the same time, cause the other of said first alignment member and said second alignment member, of which the distance is smaller, to start to be moved from the predetermined standby position to the alignment position.

8. The sheet processing apparatus according to claim 1, further comprising:

a lateral position detection unit configured to detect a lateral position of the sheet in the sheet width direction; and a shift unit configured to shift the sheet in the sheet width direction based on the lateral position detected by said lateral position detection unit before the sheet is received between said first alignment member and said second alignment member.

9. The sheet processing apparatus according to claim 8, wherein said shift unit shifts the sheet based on the skew amount and the skew direction by said detection unit.

10. The sheet processing apparatus according to claim 9, wherein when the sheet is to be discharged after being offset in the sheet width direction by a set offset amount, said shift unit shifts the sheet based on the offset amount and the skew amount and skew direction detected by said detection unit.

11. The sheet processing apparatus according to claim 10, wherein the alignment positions are determined based on the offset amount and the skew amount and skew direction detected by said detection unit.

12. The sheet processing apparatus according to claim 1, wherein said control unit identifies, out of four corner points of the sheet, a first corner point and a second corner point protruding in the sheet width direction based on the detected skew amount and skew direction, and determines the predetermined standby positions based on the first and second corner points in the sheet width direction.

13. The sheet processing apparatus according to claim 12, wherein said control unit determines, as the predetermined standby positions, positions which are spaced outward from respective positions of the first and second corner points by respective predetermined distances.

14. An image forming apparatus including:

a sheet processing apparatus, and an image forming apparatus that is connected to the sheet processing apparatus, and discharges a sheet having an image formed thereon into the sheet processing apparatus, wherein the sheet processing apparatus comprises:

a first alignment member and a second alignment member, each movable in a sheet width direction orthogonal to a sheet conveying direction, for aligning a sheet;

a moving unit configured to move each of said first alignment member and said second alignment member in the sheet width direction;

a detection unit configured to detect a skew amount and a skew direction of the sheet; and a control unit configured to control said moving unit to position said first alignment member and said second alignment member at respective predetermined standby positions before the sheet is received between said first alignment member and said second alignment member, and move one of said first alignment member and said second alignment member in a direction toward the sheet during conveyance of the sheet between said first alignment member and said second alignment member, based on the skew amount and skew direction detected by said detection unit.

* * * * *